US005390914A

United States Patent [19]

Schroeder

[11] Patent Number: 5,390,914

[45] Date of Patent: Feb. 21, 1995

[54] FOLDABLE, PORTABLE BASKETBALL GOAL ASSEMBLY

[75] Inventor: Edward A. Schroeder, Marengo, Ill.

[73] Assignee: Porter Athletic Equipment Company, Broadview, Ill.

[21] Appl. No.: 267,983

[22] Filed: Jul. 6, 1994

Related U.S. Application Data

[63] Continuation of Ser. No. 98,725, Jul. 29, 1993, abandoned.

[51] Int. Cl.[6] ..... A63B 63/08

[52] U.S. Cl. ..... 273/1.5 R; 248/158; 248/528; 248/910

[58] Field of Search ..... 273/1.5 R, 1.5 A; 248/158, 159, 514, 528, 910

[56] References Cited

U.S. PATENT DOCUMENTS

| | | | |
|---|---|---|---|
| 1,504,166 | 8/1924 | Thornley | 273/1.5 R |
| 1,924,811 | 8/1933 | Schulz | 273/1.5 R |
| 2,144,148 | 1/1939 | Gross | 273/1.5 R |
| 2,227,310 | 12/1940 | Hoppes et al. | 273/1.5 R |
| 2,818,254 | 12/1957 | Dunn | 273/1.5 R |
| 2,838,308 | 6/1958 | Polite | 273/1.5 R |
| 3,018,102 | 1/1962 | Murphy | 273/1.5 R |
| 3,025,058 | 3/1962 | Brumfield | 273/1.5 R |
| 3,137,502 | 6/1964 | Duganich | 273/1.5 R |
| 3,341,197 | 9/1967 | Bottorff | 273/1.5 R |
| 3,399,889 | 9/1968 | Harry | 273/1.5 R |
| 3,669,450 | 6/1972 | Mason | 273/1.5 R |
| 3,716,234 | 2/1973 | Lancellotti | 273/1.5 R |
| 3,722,886 | 3/1973 | Sinner | 273/1.5 R |
| 3,841,631 | 10/1974 | Dolan | 273/1.5 R |
| 4,412,679 | 11/1983 | Mahoney et al. | 273/1.5 R |
| 4,526,367 | 7/1985 | Haston | 273/1.5 R |
| 4,759,545 | 7/1988 | Grable | 273/1.5 R |
| 4,786,053 | 11/1988 | Barnes, Jr. | 273/1.5 R |
| 4,869,501 | 9/1989 | Anastasakis | 273/1.5 R |
| 4,946,163 | 8/1990 | Aakre et al. | 273/1.5 R |
| 5,098,092 | 3/1992 | Aakre et al. | 273/1.5 R |
| 5,102,128 | 4/1992 | Geise | 273/1.5 R |
| 5,112,023 | 5/1992 | Sowers | 273/1.5 R X |
| 5,149,086 | 9/1992 | Ziff | 273/1.5 R |
| 5,158,281 | 10/1992 | Williams | 273/1.5 R |
| 5,207,407 | 5/1993 | Fitzsimmons et al. | 273/1.5 R X |
| 5,220,740 | 6/1993 | Brault | 40/606 |
| 5,248,140 | 9/1993 | Matherne et al. | 273/1.5 R |
| 5,259,612 | 11/1993 | Matherne et al. | 273/1.5 R |

FOREIGN PATENT DOCUMENTS

| | | | |
|---|---|---|---|
| 2234942 | 7/1972 | Germany . | |
| 2819659 | 5/1978 | Germany . | |
| 2920903 | 12/1980 | Germany | 273/1.5 R |
| 1055574 | 1/1967 | United Kingdom | 273/1.5 R |

OTHER PUBLICATIONS

Porter "535" Portable Basketball Goal, One Sheet of Photographs, Two Sheets of Engineering Drawings, No Date On Items.

*Primary Examiner*—William H. Grieb
*Attorney, Agent, or Firm*—Barnes & Thornburg

[57] ABSTRACT

An assembly including a base having a backboard-rim combination support at one end and at least one wheel adjacent to the second end. A brace assembly is pivotally connected to the base and the support and determines, in a playing position, a fixed erect position of the support forming a substantially 90° with the base. The brace assembly, in a transport position, determines a fixed lowered position of the support forming an acute angle greater than zero with the base to aid the tilting of the base and counter-balancing the weight of the base with the weight of the backboard-rim combination during transport of the assembly. A lock assembly is operatively connected to the brace assembly for locking the brace assembly in the playing position in a locking condition of the lock and permits the brace assembly to assume the transport position in an unlocked condition of the lock.

14 Claims, 2 Drawing Sheets

FOLDABLE, PORTABLE BASKETBALL GOAL ASSEMBLY

This is a continuation of application Ser. No. 08/098,725, filed Jul. 29, 1993, now abandoned.

The present invention is generally to portable basketball goal assemblies and more specifically to foldable basketball goal assemblies.

Portable basketball goal assemblies have many structures and methods of operation. The most simple is a weighted base with a wheel wherein the erect support for the backboard is tilted back over the wheel to be transported as illustrated in U.S. Pat. No. 3,025,058 to Brumfield. Other structures have been disassembled into a planar configuration as illustrated by U.S. Pat. Nos. 3,716,234 to Lancellotti and 4,869,501 to Anastasakis. Others include a vertical support structure which collapses vertically as illustrated in U.S. Pat. Nos. 4,526,367 to Haston, et al. and 5,102,128 to Geise. An example of a system using pivotal links or braces to collapse the assembly into a planar position and rotating it up on a series of wheels is illustrated by U.S. Pat. Nos. 4,946,163 and 5,098,092 to Aakre, et al. Further examples of wheeled bases which are portable without adjustment are shown by U.S. Pat. Nos. 3,722,886 to Sinner and 5,207,407 to Fitzsimmons, et al. In the addition to the above, an example of a wheeled support having an enclosure for receiving ballast was exemplified by U.S. Pat. No. 3,841,631 to Dolan.

In designing a portable basketball goal assembly there are many design criteria which must be balanced. Some of the goals are designed strictly for transporting and not for storage. Others are made to be transported and stored and therefore break down into a fiat stored position. Others are transportable and storable by collapsing the support structure with the backboard and rim combination vertically. Some of the systems have permanent weight in the base and others are either stabilized by sandbags or include a hollow base to which ballast may be added or removed. If wheels are not included, the hollow base must be emptied of the ballast to be moved. Those with wheels may be moved with the ballast, and thus the ease of operation to move from a playing position of the system to a transport position of the system is important. The ability to counter-balance the weight of the base during transport must be addressed.

Another important design criteria is the footprint of the basketball goal assembly. The footprint is defined as the area including the base to the backboard. This is the area that would be needed to accommodate the assembly structure. The dimension to be minimized is the length from the rear of the base to the backboard. This is especially important when a portable basketball unit is used on driveways, carport aprons, etc. The most efficient footprint is to have the support for the backboard-rim combination vertical, but this makes the transporting of the system, without breaking it down, more difficult. Thus, there exists a need for a portable basketball goal assembly with a minimum footprint while having ease of transport.

Thus it is an object of the present invention to provide a portable basketball assembly with a minimum footprint and being easy to transport.

Another object of the present invention is to provide a portable basketball goal assembly which has a playing and a transport position which allows counterbalancing of the weight of the base.

An even further object of the present invention is to provide a portable goal basketball assembly which is easy to convert from an erect play position to a lowered transport position.

These and other objects are achieved by providing a base having a backboard-rim combination support at one end and at least one wheel adjacent to the second end. A brace assembly is pivotally connected to the base and the support and determines, in a playing position, a fixed erect position of the support forming a substantially 90° with the base. The brace assembly, in a transport position, determines a fixed lowered position of the support forming an acute angle greater than zero with the base to aid the tilting of the base and counter-balancing the weight of the base with the weight of the backboard-rim combination during transport of the assembly. A lock assembly is operatively connected to the brace assembly for locking the brace assembly in the playing position in a locking condition of the lock and permits the brace assembly to assume the transport position in an unlocked condition of the lock.

The brace assembly includes at least two braces pivotally connected to each other having preselected lengths to determine the acute angle which is a function of the ratio of the weight of the backboard-rim combination to the weight of the base. This angle is in the range of 50° to 75°. The brace assembly is connected to the base along the same axis to the wheels and generally includes a common pin. A portion of the brace engages the support in the lowered position of the support and a stabilizing element cooperatively interconnects the support and the brace for stabilizing the brace in the lowered position of the support. A sheath is provided for covering the overlapping of the ends of the two braces and the lock is attached to the shroud. The base is a hollow element filled with ballast and the volume diminishes from the wheeled end to the end to which the support is pivoted.

The method of transporting includes unlocking the braces in their playing position with the support in its fixed erect position and pivoting the braces and support from their playing and erect positions to their transport and fixed lowered positions. Continuing the angle motion of the support to tilt the base onto the wheel and counter-balance the weight of the base with the weight of the backboard-rim combination during transport. The braces in their playing position are coaxial and are pivoted to an angular transport position with one of the braces engaging the support. The acute angle during transport is selected to achieve the counter-balance for a substantial horizontal position of the support during transport.

Other objects, advantages and novel features of the present invention will become apparent from the following detailed description of the invention when considered in conjunction with the accompanying drawings.

DETAILED DESCRIPTION OF THE DRAWINGS

Figure 1:
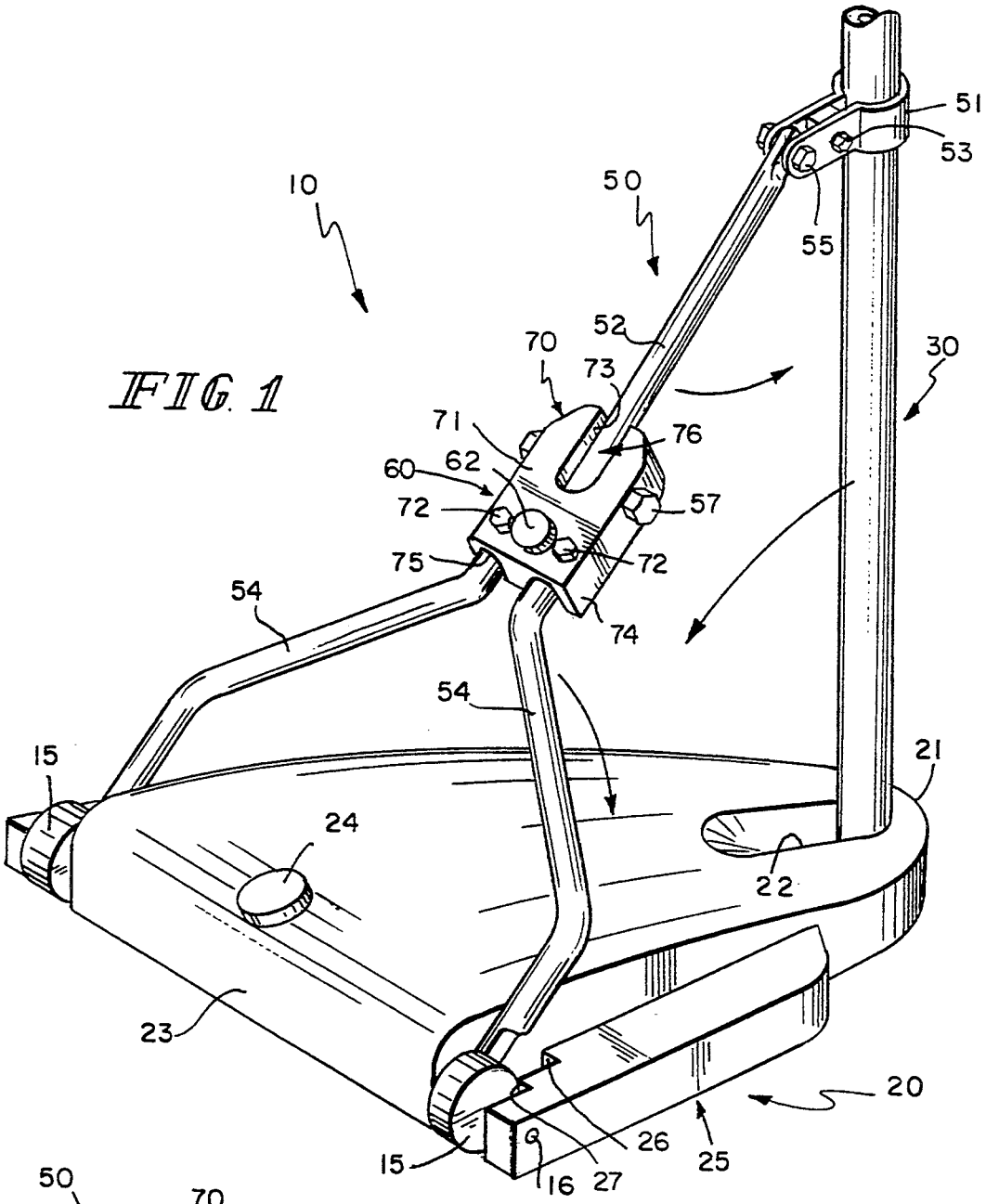
FIG. 1 is a perspective view of a foldable, portable basketball goal assembly without the backboard-rim combination according to the principles of the present invention.
Figure 3:
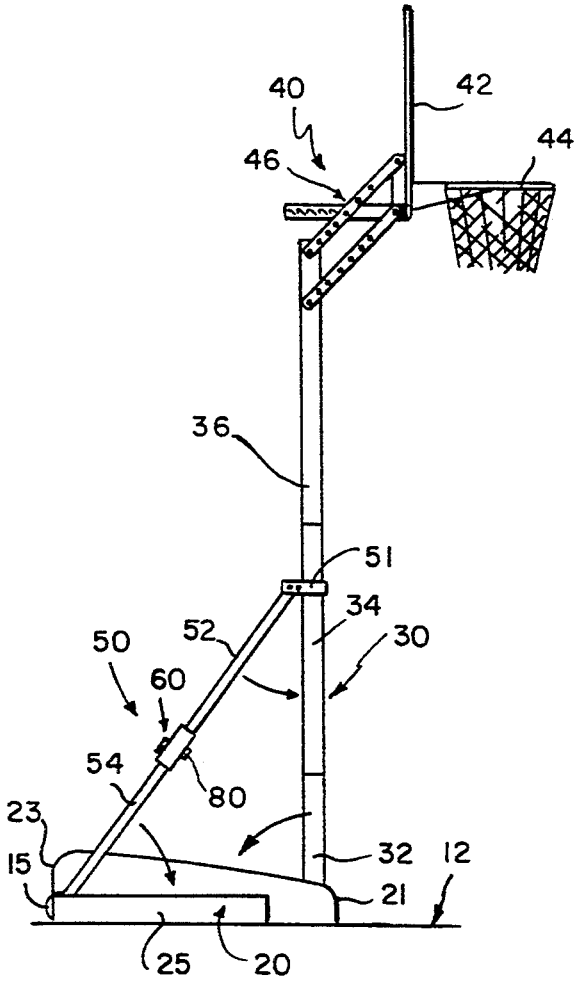
FIG. 3 is a side schematic view of the foldable, portable basketball goal assembly of FIG. 1 in its playing condition.
Figure 4:
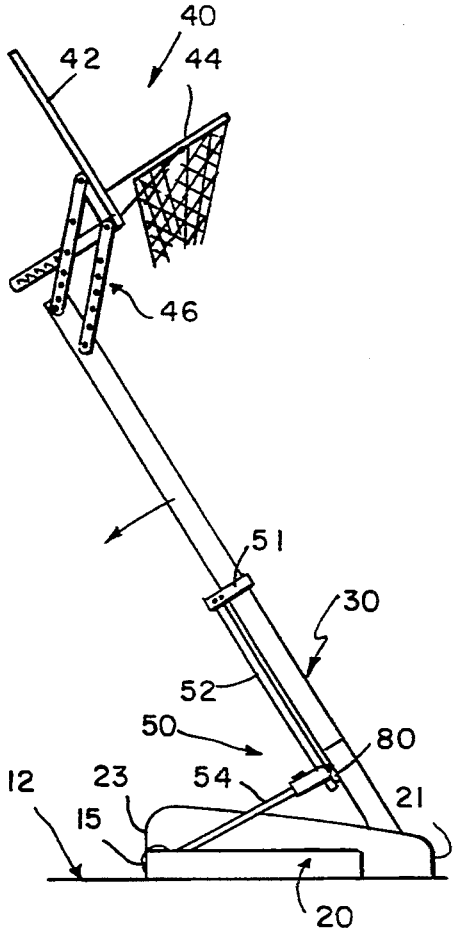
FIG. 4 is a side schematic view of the foldable, portable basketball goal assembly of FIG. 1 in its lowered position.
Figure 5:
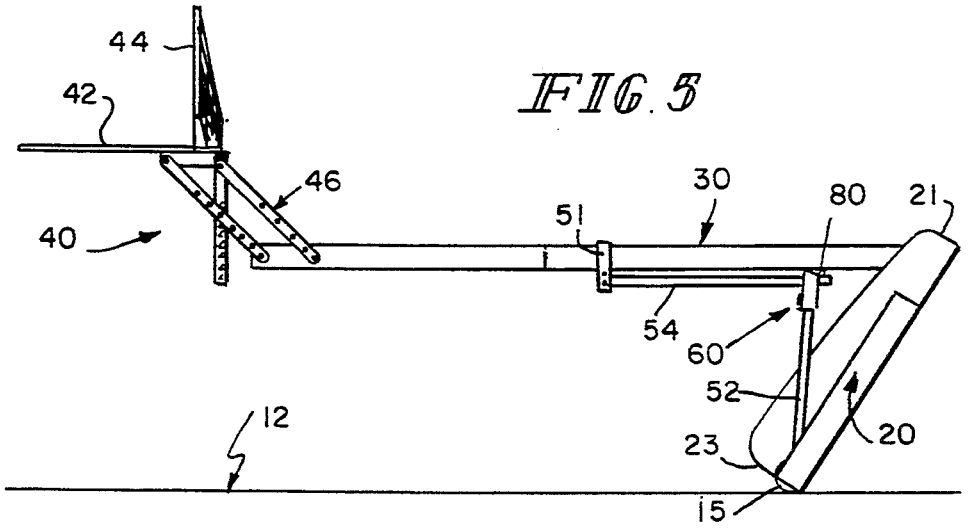
FIG. 5 is a schematic side view of the foldable, portable basketball goal assembly of FIG. 1 in its transport position.

A foldable, portable basketball assembly 10 is illustrated in FIG. 1 as including a base 20, a support 30 pivotally connected to the base 20 adjacent the front end 21 of the base 20 and wheels 15 connected adjacent a rear end 23 of the base 20. A backboard-rim assembly 40, shown in FIGS. 3–5, is connected to the support 30. A brace assembly 50, including upper brace 52 and lower braces 54, is pivotally connected to the base 20 and support 30 at its ends. A lock 60 maintains the brace assembly 50 in its play position as illustrated in FIGS. 1 and 3 and when unlocked allows the brace assembly to assume its transport positions as illustrated in FIGS. 4 and 5. A shroud 70 is provided on the brace assembly 50 and receives the lock 60. A stabilizing element 80 is secured to brace 52 of the brace assembly 50 by fastener 82 and stabilizes the brace 52 when it engages support 30 in the transport position as illustrated in FIGS. 4 and 5.

Figure 2:
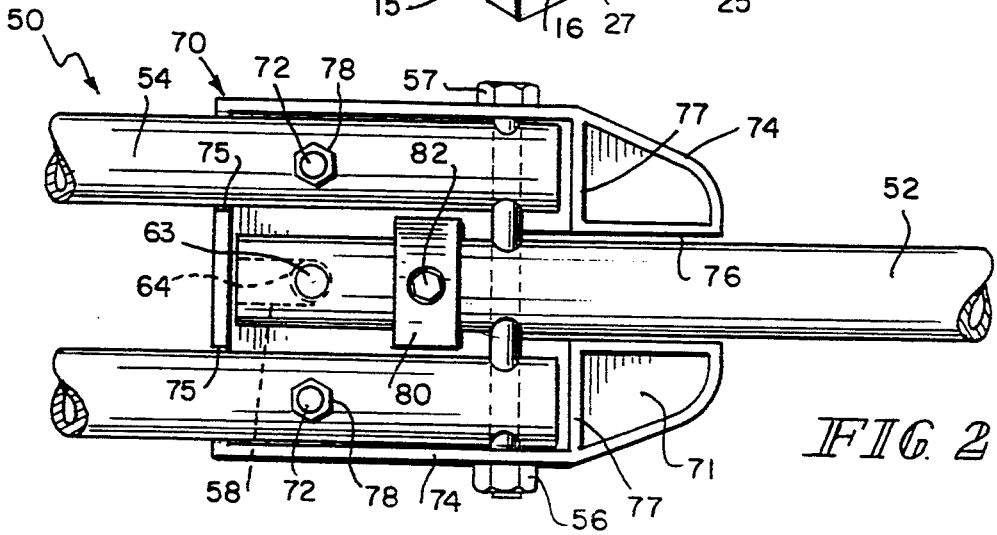
FIG. 2 is a bottom view of a portion of the assembly of FIG. 1.

The foldable, portable basketball assembly as illustrated in FIGS. 1, 2 and 3 has the brace assembly 50 in its playing position with the support 30 in its erect position. The support 30 forms a substantially 90° angle with the base 20 and the ground or court surface 12. The lock 60 maintains brace assembly 50 in its play position with the pair of braces 52 and 54 in their coaxial position. To transport the assembly, lock 60 is unlocked. To assume its lowered transport position as illustrated in FIGS. 4 and 5, the support 30 is rotated backwards and the brace assembly 50 is rotated forward until the brace 54 comes into contact with support 30 as illustrated in FIG. 4. The stabilizing element 80, having a curved surface, engages support 30 and prevents lateral movement of the brace assembly 50. The support 30 then extends back over the base 20 at an angle defined by the length of the braces 52 and 54. The angle preferably is in the range of 50° to 75° and is a function of the weight of the base 30 filled with ballast compared to the weight of the backboard-rim assembly 40. The acute angle is preferable at 60° for a typical backboard-rim assembly of 20 to 30 pounds and ballast filled base in the range of 250 pounds.

Continued angular motion of the support 30 from the position shown in FIG. 4 will tilt the base 20 on the wheels 15 so as to support the weight of the base on the wheels as illustrated in FIG. 5. In the non-tilted positions of FIGS. 1, 3 and 4, the wheels 15 are displaced from the ground or surface 12. The acute angle of the support relative to the base 20 as defined by the brace assembly 50 is selected such that the weight of the base 20 is counter-balanced by the backboard-rim assembly 40 when the support 30 is in a substantially horizontal position. This allows ease of transport by minimizing the weight of the system on an individual.

The base 20 has a volume tapered from the rear end 23 diminishing to the front end 21. This shifts the center of gravity of the base 20 closer to the wheels 15 in any of the tilted positions of the base 20. The base 20 preferably is a molded plastic hollow base having the tapered volume. The cap 24 provides access to the interior of the base 20, allowing it to be filled by ballast material for example, sand, water, etc. A curved recess 22 in the front end of the base 20 accommodates the pivotal motion of the support 30 from its erect position of FIGS. 1 and 3 to its lowered position of FIGS. 4 and 5. Preferably, the support 30 engages the lateral edges of recess 22 for stability, but does not engage the rear edge of the recess 22 even in its lowered position. Flanges 25 extend from each side of the base 20 and includes a recess 26 for the braces 54 and a second recess 27 for the wheels 15. A common pin or bolt 16 pivotally connects the wheel 15 and the brace 54 to the base between the side flange 25 and the main body of the base 20. The wheels 15 are dimensioned so as to be displaced from the surface 12 when the base 20 is not tilted as illustrated in FIGS. 1 and 3. Once the base 20 is tilted to a transport position as illustrated in FIGS. 4 and 5, the wheels 15 intersect the ground lifting the base therefrom. Although the braces 54 are connected by a common pin 16 with the wheels 15 to the base 20, separate connections at different positions along the base may be provided. For example, the base 20 may be extended and the braces 54 may be connected closer to the front of the base 20. Also the wheels 15 may be provided on the back wall of the base 20. Both of these suggestions would extend the length of the base and therefor increase the footprint.

The support 30, as illustrated in FIG. 1, may be a single pole or hollow pipe. Preferably, it is a multi-segment element as illustrated in FIG. 3 having sections 32, 34 and 36. This allows ease of packaging of the system. The elements 32, 34 and 36 preferably are configured to have a press fit configuration requiring no additional tools for assembly. The combined backboard-rim assembly 40, as illustrated in FIGS. 3–5, includes a backboard 42 and a rim 44 with a height adjustment mechanism 46. Although a parallelogram structure is illustrated as a height adjustment 46, any other type of height adjustment may be used, or a direct mount of the backboard 42 and rim 44 to the support 30 can be used.

The brace assembly 50 includes the brace 52 pivotally connected at its first end to a bracket or damp 51 by pin 55. A pin 53 secures the C-bracket 51 to the support 30 at a fixed position. Other clamps or devices may be used to pivotally connect the brace 52 to the support 30 at a fixed position. The pair of braces 54 each are connected, as previously described, to the base 20 by pins 16. The braces 52 and 54 are pivotally connected to each other by a pin 57 having a nut 56 as illustrated in FIG. 2. A slot 58 (as illustrated in phantom in FIG. 2) in the top surface of the lower end of the brace 52 accommodates the lock mechanism 60 to be described.

The lock mechanism 60 includes a hand wheel 62 with a threaded shaft 63 and is mounted to the sheath 70 by a nut or clip and extends there through. A threaded aperture 64 is provided on the lower end of the upper brace 52 and is illustrated as a nut in FIG. 2. When the braces 52 and 54 are coaxial in their playing position, the threaded shaft 63 of hand wheel 62 is aligned with the threaded aperture 64. Hand wheel 62 then threads the thread shaft 63 into the threaded aperture 64. This locks the braces 52 and 54 in their coaxial playing position and maintains the support 30 in its erect position. When the lock 60 is in its unlocked position, the thread shaft 63 is disengaged from the thread aperture 64 and the braces 52 and 54 may rotate down to their transport position. The slot 58 in the top surface of the lower end of the brace 52 accommodates the movement of the threaded shaft 63 between the playing and transport position of the brace assembly 50.

The sheath 70 includes a top surface 71 and a pair of fasteners 72 for mounting the sheath 70 to the upper end of braces 54. Nut 78, as illustrated in FIG. 2, receives the fasteners 72. A cut out 73 in the top surface 71 of the sheath 70 accommodates the motion of the brace 52 as it moves towards its transport position. The sheath 70 also includes sidewall 74 having a pair of cut outs 75 to receive the braces 54 and a cut out 76 which is an extension of cut out 73 to receive the brace 52 when the brace assembly 50 is in its playing position. As illustrated in FIG. 2, a pair of ribs 77 are provided extending between sections of the sidewalls 74 to add rigidity to the sheath. The sheath 70 covers the overlapping end portions of the braces 52 and 54 and provides some degree of protection preventing fingers from being caught therebetween. The sheath also protects the pivotal portions as well as the exposed ends from the environment.

As a typical example of the dimensions of the system, the base 20 has a length from the front 21 to the rear surface 2.3, for example, of 47 inches. The displacement of the backboard 42 from the front edge 21 of the base is approximately 15 inches to produce an overall footprint of 62 inches. To define the sixty degree angle between the support 30 and the base 20, the brace 52 would have a length of 32 ½ inches and the brace 54 would have a length of 32½ inches and be pivotally connected to have a total length of 62 inches.

The disclosed dimensions are only one of those cited by way of example and not by way of limitation. Preferably the acute angle is defined by the length of the brackets 52 and 54 by the manufacturer with their pivotal position to the support 30 being fixed for safety's sake. If the bracket 51 slides along the support 30, it would allow the support 30 to totally collapse and injure the user. By the proper triangulation of the support 30 and base 20, the support 30 will be locked vertical to the playing surface without the need of stop collars or a level to plum the support. The use of stop collars also creates a surface which could pinch the fingers. The present system is designed for maximum safety for the user during play and conversion of the system from its erect playing position to its lowered transport position. The system of counter-balances allows ease of transport by users of any age or strength.

Although the present invention has been described and illustrated in detail, it is to be dearly understood that the same is by way of illustration and example only, and is not to be taken by way of limitation. The spirit and scope of the present invention are to be limited only by the terms of the appended claims.

What is claimed:

1. A foldable portable basketball goal assembly comprising:

a base having first and second ends and a first weight;

a support pivotally connected adjacent said first end of said base;

a backboard-rim combination connected to said support and having a second weight substantially less than said first weight;

at least one wheel adjacent said second end of said base for transporting said assembly when said base is tilted;

first and second brace means, of preselected lengths, pivotally connected to each other at their first ends and pivotally connected at their second ends respectively at fixed positions to said base and said support;

said first and second brace means determining, in a playing position, a fixed erect position of said support forming substantially a ninety degree angle with said base, predetermined by said preselected lengths of said first and second brace means and, in a transport position, a fixed lowered position of said support forming an acute angle greater than zero with said base, predetermined by said preselected lengths of said first and second brace means, to aid tilting of said base and counter-balancing the weight of said base with the weight of said backboard-rim combination during transporting of said assembly;

lock means operatively connected to said first and second brace means for locking said first and second brace means in said playing position in a locking condition of said lock means and permitting said first and second brace means to assume said transport position in an unlocked condition of said lock means.

2. The assembly according to claim 1, wherein said preselected lengths of said first and second brace means determine an acute angle as a function of the ratio of said second weight to said first weight.

3. The assembly according to claim 1, wherein said preselected lengths of said first and second brace means determine an acute angle in the range of 50 to 75 degrees.

4. The assembly according to claim 1, wherein said second end of said first brace means is connected to said base along the same axis as is said wheel.

5. The assembly according to claim 4, wherein said first brace means includes a pair of first braces and including a pair of wheels; and a first brace and a respective wheel are connected at a respective side of said base on a common pin.

6. The assembly according to claim 1, wherein said second brace means engages said support in said lowered position of said support to determine said fixed lowered position.

7. The assembly according to claim 6, including stabilizing means cooperatively interconnecting said support and said second brace means for stabilizing said second brace means in said lowered position of said support.

8. The assembly according to claim 1, wherein said first brace means includes a pair of first braces pivotally connected at their first ends on each side of the first end of said second brace means; and including a shroud covering the overlap of the first ends of said first and second brace means in said playing position.

9. The assembly according to claim 8, wherein said locking means includes a threaded shaft connected to said shroud and a threaded aperture on said first end of said second brace means and aligned with said threaded shaft in said playing position.

10. The assembly according to claim 1, wherein said base is hollow and filled with ballast.

11. The assembly according to claim 1, wherein the volume of said base diminishes from said second end towards said first end.

12. The assembly according to claim 1, wherein said brace means is connected to said base along the same axis as is said wheel.

13. A method of transporting a basketball goal assembly having a support pivotally connected adjacent a first end of a weighted base, a backboard-rim combination on said support and having a weight substantially less than said base, at least one wheel adjacent a second end of said base, a pair of braces pivotally connected to each other at their first ends and pivotally connected at their second ends respectively to said base and said support for determining in a playing position a fixed erect position of said support forming substantially a ninety degree angle with said base and in a transport position a fixed lowered position of said support forming an acute angle greater than zero with said base; the method comprising:

unlocking said said braces in their co-axial playing position with said support in said fixed erected position;

pivoting said braces and said support from said co-axial playing and erect positions until one of said braces engages said support to define said transport and fixed lowered positions; and continuing the angular motion of said support to tilt said base onto said wheel and counter-balance the weight of the base with the weight of the backboard-rim combination during transport.

14. The method according to claim 13, including selecting said acute angle to achieve said counter-balance for a substantially horizontal position of said support during transport.

* * * * *